US007357730B2

(12) United States Patent
Shieh

(10) Patent No.: US 7,357,730 B2
(45) Date of Patent: Apr. 15, 2008

(54) GOLF CLUB HEAD

(76) Inventor: Tien Wu Shieh, 3 Zara Street, Robertson Brisbane, Queensland 4109 (AU)

( * ) Notice: Subject to any disclaimer, the term of this patent is extended or adjusted under 35 U.S.C. 154(b) by 0 days.

(21) Appl. No.: 11/514,045

(22) Filed: Aug. 31, 2006

(65) Prior Publication Data

US 2008/0058118 A1 Mar. 6, 2008

(51) Int. Cl.
*A63B 53/04* (2006.01)

(52) U.S. Cl. ..... 473/342; 473/345

(58) Field of Classification Search ..... 473/342, 473/332, 345–346

See application file for complete search history.

(56) References Cited

U.S. PATENT DOCUMENTS 7,144,334 B2 * 12/2006 Ehlers et al. ..... 473/329
7,214,144 B2 * 5/2007 Tseng ..... 473/345
2002/0165040 A1 * 11/2002 Kosmatka et al. ..... 473/332
2005/0026718 A1 * 2/2005 Chen ..... 473/342

* cited by examiner

*Primary Examiner*—Stephen Blau
(74) *Attorney, Agent, or Firm*—Pro-Techtor Int'l Services

(57) ABSTRACT

A golf club head comprises a body defined with a hollow part thereof, an annular groove is defined in a front side of the hollow part, and an annular space is formed between the annular groove and the body. And a hitting panel, in a periphery of a rear side of the hitting panel is disposed an annular wall, and the hitting panel and the annular wall are retained in the annular groove of the body respectively. Therefore, the hitting force is blocked by the annular space, and will not transmit to the body, thus decreasing the waste of the hitting force.

1 Claim, 4 Drawing Sheets

GOLF CLUB HEAD

BACKGROUND OF THE INVENTION

1. Field of the Invention

The present invention relates to a golf club head, and more particularly to a golf club head which can decrease the output waste of the hitting force.

2. Description of the Prior Art

Conventional golf club heads are classified into two types, the first type as shown in FIG. 1, wherein a hitting panel 101 is disposed on the front side of a body 10. And the second type is shown in FIG. 2, a groove 201 is formed in the front side of a body 20 for retaining a hitting panel 30.

When playing golf, the golf is hit by the hitting panel 101 and 30, and the hitting force will transmitted to the body 10 and 20, so that the body 10 and 20 will be deformed and will adversely affect the hitting stability and distance.

The present invention has arisen to mitigate and/or obviate the afore-described disadvantages.

SUMMARY OF THE INVENTION

The primary objective of the present invention is to provide a golf club head comprises a hollow body having a recess with a central opening formed on a front side of the hollow body, and a hitting panel with an annular wall thereof, the hitting panel and the annular wall are retained in the recess of the hollow body.

An annular space is formed between the periphery of the recess and a peripheral sidewall of the hollow body, thus preventing the hitting force from being absorbed by the body so as to decrease the waste of the hitting force.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
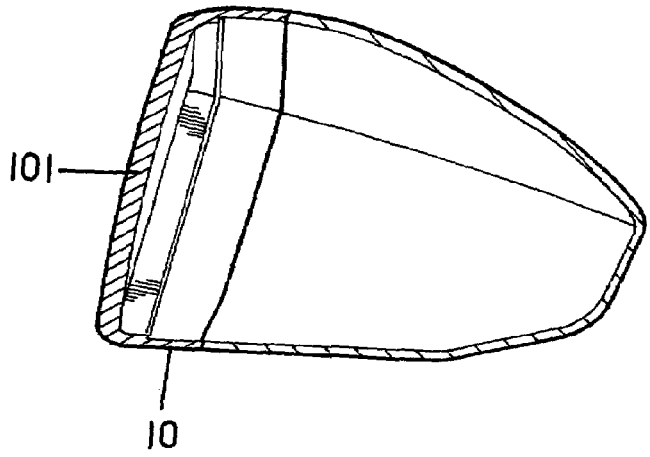
FIG. 1 (Prior Art)
FIG. 1 is a cross sectional view of a conventional golf club head.
Figure 2:
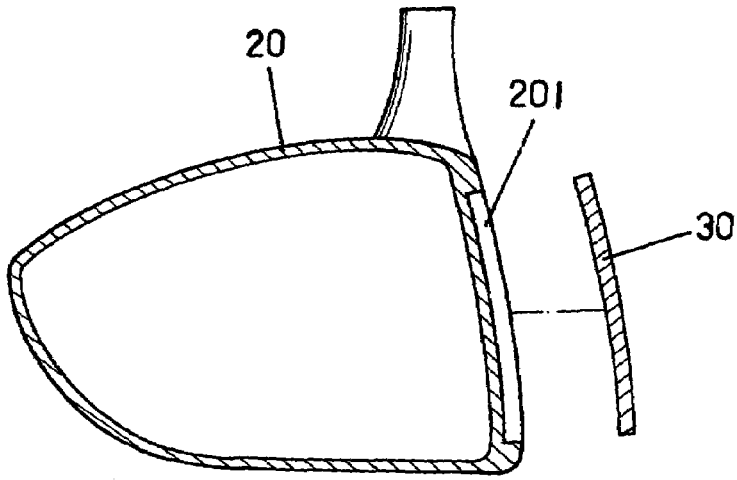
FIG. 2 (Prior Art)
FIG. 2 is an exploded view of another conventional golf club head.
Figure 3:
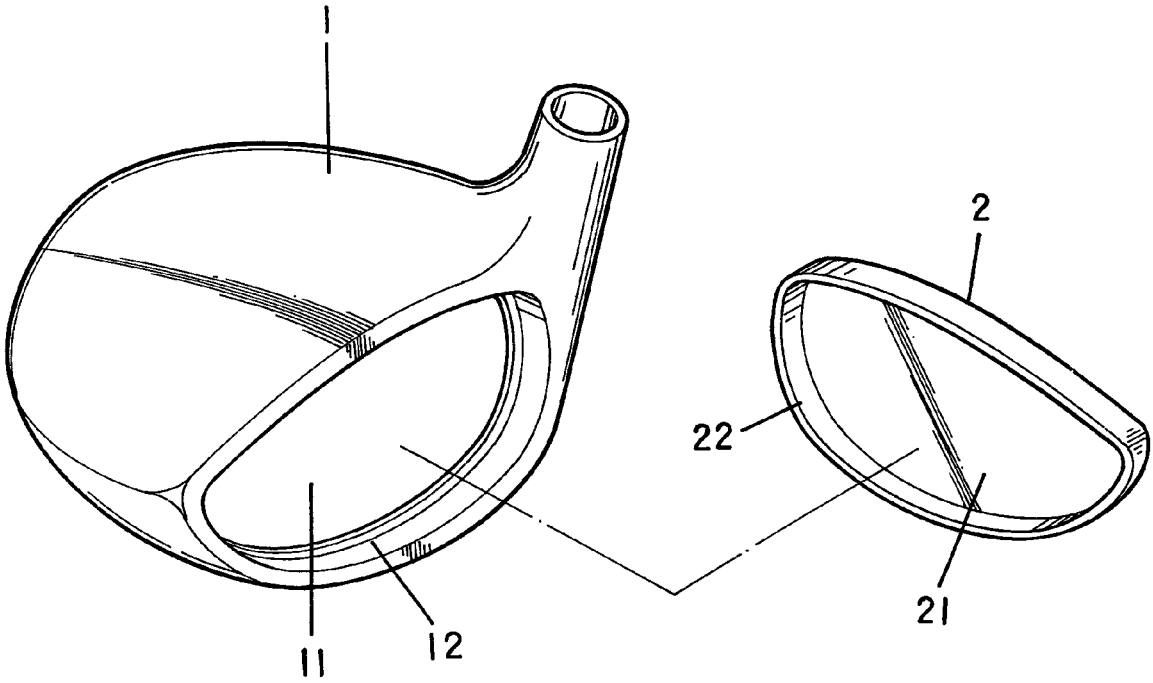
FIG. 3 is an exploded view of a golf club head in accordance with the present invention.
Figure 4:
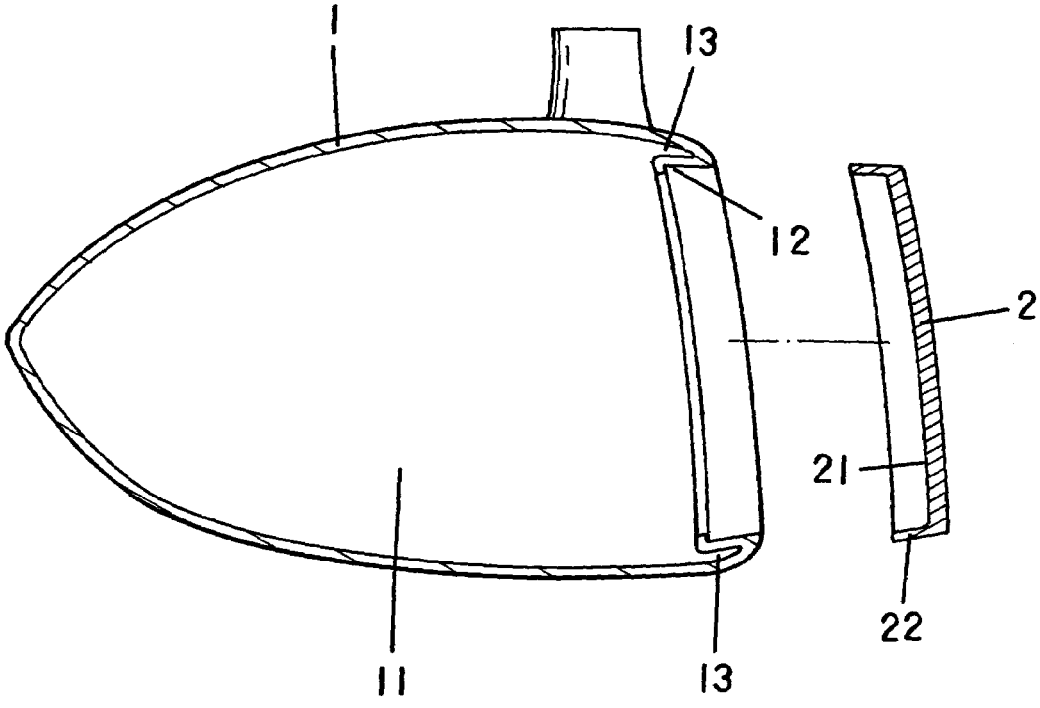
FIG. 4 is another exploded view of the golf club head in accordance with the present invention.

Referring to FIGS. 3 and 4, a golf club head in accordance with the present invention comprises a hollow body 1 and a hitting panel 2.

Figure 6:
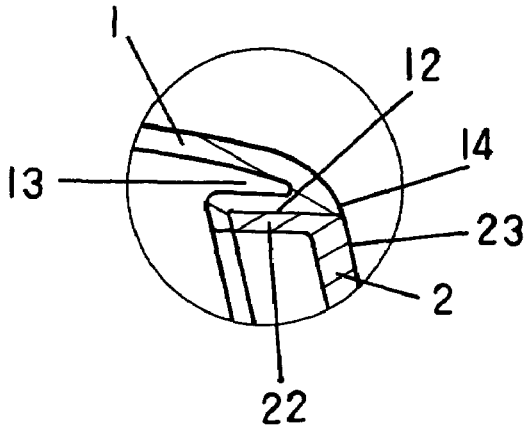
FIG. 6 is another cross sectional view of a part of the golf club head in accordance with the present invention.
Figure 5:
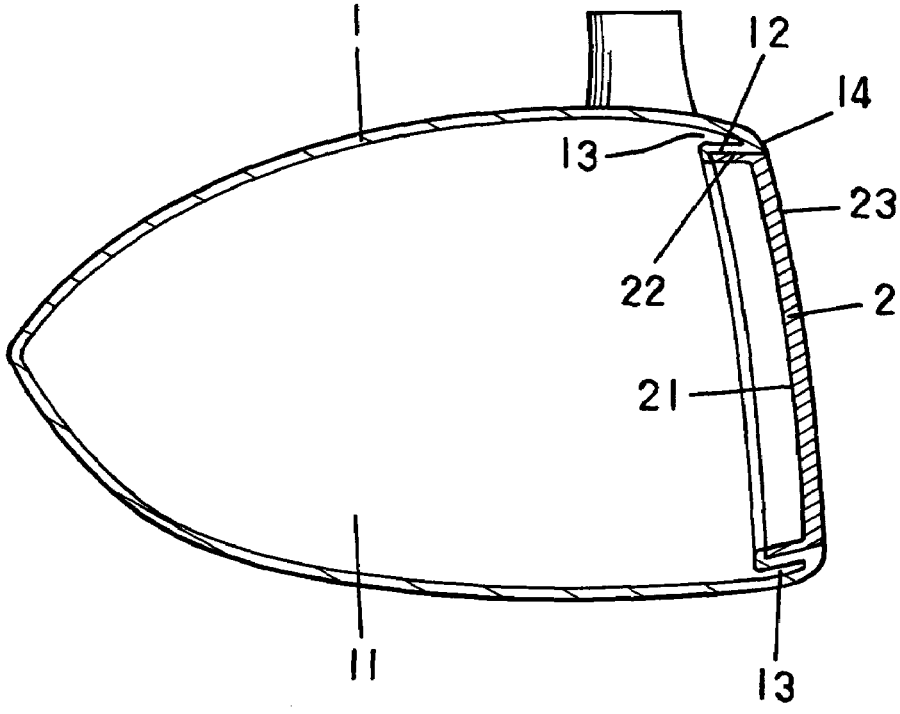
FIG. 5 is an assembly cross sectional view of the golf club head in accordance with the present invention.

The hollow body 1 includes a hollow part 11, a recess 12 is defined in a front side of the hollow body 1, and an annular space 13 is formed between the peripheral sidewall of the recess 12 and the hollow body 1. A recessed central portion on a rear side 21 of the hitting panel 2 defines an annular wall 22, the hitting panel 2 and the annular wall 22 are retained in the recess 12 of the hollow body 1, and a front side 23 of the hitting panel 2 is at the same level with a front side 14 of the hollow body 1 (as shown in FIGS. 5 and 6).

When playing golf, the golf ball is hit by the front side 23 of the hitting panel 2, and the hitting force is blocked by the annular space 13 when transmitted to the annular wall 22 and the annular groove 12, thus preventing the hitting force from being absorbed by the hollow body 1.

Since the hitting force is only applied on the hitting panel 2, and will not be absorbed by the body 1, the output waste of the hitting force is effectively decreased, which has the advantages described as follows:

Firstly, the hitting force will not be applied on the body 1, so that the body 1 will not be deformed and the life can be prolonged.

Secondly, the output waste of the hitting force is decreased, thus obtaining the best hitting stability and distance.

While we have shown and described various embodiments in accordance with the present invention, it should be clear to those skilled in the art that further embodiments may be made without departing from the scope of the present invention.

What is claimed is:

1. A golf club head, comprising:

a hollow body having a recess on a central portion of a front side thereof, with a central opening at a bottom thereof, the opening being smaller than the recess defining a ledge at the bottom of the recess, an annular space being defined inside of the hollow body between a peripheral sidewall of the hollow body and a peripheral sidewall of the recess;

a hitting panel having a rear side with a recessed central portion defining an annular wall formed on a periphery thereof, the annular wall being adapted to fit against the bottom of the recess of the hollow body and to be retained therein.

* * * * *